US008827004B2

(12) United States Patent
Hosokawa et al.

(10) Patent No.: US 8,827,004 B2
(45) Date of Patent: Sep. 9, 2014

(54) POWER TOOL HAVING OFF-LOCK MEMBER

(75) Inventors: Nobuhito Hosokawa, Hitachinaka (JP); Junichi Konishi, Hitachinaka (JP); Kazumi Tanaka, Hitachinaka (JP); Yuuki Takeda, Hitachinaka (JP)

(73) Assignee: Hitachi Koki Co., Ltd., Tokyo (JP)

( * ) Notice: Subject to any disclaimer, the term of this patent is extended or adjusted under 35 U.S.C. 154(b) by 333 days.

(21) Appl. No.: 13/026,147

(22) Filed: Feb. 11, 2011

(65) Prior Publication Data

US 2011/0203826 A1 Aug. 25, 2011

(30) Foreign Application Priority Data

Feb. 19, 2010 (JP) ..... 2010-034494

(51) Int. Cl.

| | |
|---|---|
| ***B23B 45/00*** | (2006.01) |
| ***B25F 5/02*** | (2006.01) |
| ***B27B 5/38*** | (2006.01) |
| ***B24B 23/02*** | (2006.01) |

(52) U.S. Cl.

CPC ... *B25F 5/02* (2013.01); *B27B 5/38* (2013.01); *B24B 23/02* (2013.01)

USPC ..... 173/170; 173/217

(58) Field of Classification Search

USPC ..... 173/216, 217, 170; 200/43.16, 43.17

See application file for complete search history.

(56) References Cited

U.S. PATENT DOCUMENTS

| | | | | |
|---|---|---|---|---|
| 1,929,662 A | | 10/1933 | Wappat | |
| 2,072,551 A | | 3/1937 | Forss | |
| 3,823,291 A | * | 7/1974 | Milcoy | 200/43.17 |
| 3,847,233 A | * | 11/1974 | Glover et al. | 173/170 |
| 3,952,239 A | * | 4/1976 | Owings et al. | 320/113 |
| 4,006,334 A | * | 2/1977 | Robotham et al. | 200/43.17 |
| 6,259,047 B1 | * | 7/2001 | Kimata et al. | 200/43.17 |
| 6,700,091 B2 | * | 3/2004 | Jones et al. | 219/121.48 |
| 7,232,970 B1 | * | 6/2007 | Chen | 200/332.2 |
| 8,198,560 B2 | * | 6/2012 | Kimata et al. | 200/318.1 |
| 2005/0196273 A1 | * | 9/2005 | Nishikawa et al. | 415/206 |

FOREIGN PATENT DOCUMENTS

| | | |
|---|---|---|
| CN | 2324625 Y | 6/1999 |
| CN | 1663749 A | 9/2005 |
| EP | 2207191 A2 | 7/2010 |

OTHER PUBLICATIONS

"Hitachi, Model G 12SE2 • G 13SE2 Disc Grinder; Safety Instructions and Instruction Manual," Hitachi Koki Co., Ltd., Minato-Ku, Tokyo, Japan, pp. 1-52.

Office Action from China Intellectual Property Office for application CN201110040014.2 (May 30, 2013).

Extended European Search Report for European patent application EP11000867.9 (Jul. 25, 2014).

* cited by examiner

*Primary Examiner* — Andrew M Tecco

(74) *Attorney, Agent, or Firm* — Kilpatrick Townsend and Stockton LLP

(57) ABSTRACT

A power tool includes a motor, a housing that accommodates the motor, a switch that supplies power to the motor, a switch lever that is provided movable relative to the housing to selectively turn ON and OFF the switch, and an off-lock member that is provided movable relative to the switch lever. The off-lock member includes a first engaging part and a second engaging part that are engageable with the housing.

8 Claims, 6 Drawing Sheets

POWER TOOL HAVING OFF-LOCK MEMBER

CROSS REFERENCE TO RELATED APPLICATION

This application claims priority from Japanese Patent Application No. 2010-034494 filed Feb. 19, 2010. The entire content of this priority application is incorporated herein by reference.

TECHNICAL FIELD

The present invention relates to a power tool having an off-lock member.

BACKGROUND

There has been provided a power tool having a switch called an "off-lock switch," which is not turned ON by simply operating a switch lever. A G12SE2 disc grinder produced by Hitachi Koki Co., Ltd., for example, employs the off-lock switch.

The switch lever of the off-lock switch used in power tools manufactured by Hitachi Koki Co., Ltd can only be operated after operating an off-lock lever provided to the switch lever. In order to enhance operability of the off-lock switch, the switch lever is configured to extend along a direction in which an outer frame (housing) of the power tool extends, and the off-lock lever is provided at the midpoint of the switch lever.

SUMMARY

However, with the above-described configuration, there is a danger that the switch lever moves to accidentally turn ON the off-lock switch, wasting power.

In view of the foregoing, it is an object of the invention to provide a power tool that can prevent waste of power by employing a switch lever that hardly moves.

It is another object of the invention to provide a power tool that can prevent waste of power by preventing an accidental power ON.

In order to attain the above and other objects, the invention provides a power tool includes a motor, a housing that accommodates the motor, a switch that supplies power to the motor, a switch lever that is provided movable relative to the housing to selectively turn ON and OFF the switch, and an off-lock member that is provided movable relative to the switch lever. The off-lock member includes a first engaging part and a second engaging part that are engageable with the housing.

The power tool preferably further includes a presser bar. The off-lock member is preferably movable between a first position and a second position relative to the switch lever. The first engaging part and the second engaging part are preferably in engagement with the housing when the off-lock member is at the first position so as to regulate the movement of the switch lever relative to the housing, and the first engaging part and the second engaging part are preferably out of engagement with the housing when the off-lock member is at the second position so as to allow the movement of the switch lever relative to the housing. The switch lever may selectively turn ON and OFF the switch via the presser bar.

It is preferable that the housing extend in a predetermined direction from a first side toward a second side and be provided with an engaging member on the second side, that the switch lever have a first end on the first side and a second end on the second side, that the off-lock member have an off-lock lever provided with the first engaging part, the off-lock lever being disposed at the midpoint of the switch lever with respect to the predetermined direction and separate from the second engaging part in the predetermined direction, and that the second engaging part be engageable with the engaging member.

According to another aspect, the present invention provides a power tool including a motor, a housing that accommodates the motor, a housing having a first side and a second side opposite to the first side, a gear disposed at the first side in the housing, a bit holder that is connected to the gear, a power supply member disposed at the second side of the housing, a switch provided between the power supply member and the motor, a switch lever that is provided movable relative to the housing to selectively turn ON and OFF the switch, the switch lever having a first end on the first side and a second end on the second side, and an off-lock member that is provided movable relative to the switch lever. The off-lock member has an off-lock lever disposed at the midpoint of the switch lever between the first end and the second end of the switch lever. The housing is provided with an engaging member located at the second side. The off-lock member has a third end on the second side that is engageable with the engaging member.

The power tool may further include an urging member that urges the off-lock member toward the second side.

The power tool may further include a presser bar, and the off-lock member is preferably movable between a first position and a second position relative to the switch lever. The third end of the off-lock member is preferably in engagement with the engaging member when the off-lock member is at the first position so as to regulate the movement of the switch lever relative to the housing, and the third end of the off-lock member is preferably out of engagement with the engaging member when the off-lock member is at the second position so as to allow the movement of the switch lever relative to the housing. The switch lever may selectively turn ON and OFF the switch via the presser bar.

According to still another aspect, the prevent invention further provides a power tool including a motor, a switch that supplies electric power to the motor, a housing that accommodates the motor and extends in a predetermined direction from a first side to a second side, a switch lever that is disposed movable relative to the housing so as to selectively turn ON and OFF the switch, and an off-lock member that is disposed movable relative to the switch lever. The off-lock member includes an operation part and an engaging part disposed separate from the operation part in the predetermined direction. The engaging part is engageable with the housing.

The switch preferably includes a protrusion protruding from one end of the switch in the predetermined direction, and the switch lever preferably extends in the predetermined direction and is capable of operating the protrusion.

The housing preferably includes a motor housing that accommodates the motor and a tail cover that accommodates the switch, and the operation part of the off-lock member is preferably located at a first section of the tail cover on the first side. The off-lock member preferably includes a key that extends in the predetermined direction, and the engaging part is preferably provided to the key and is engageable with a second section of the tail cover on the second side.

The engaging part preferably engages with the housing, thereby preventing the switch lever from moving.

The power tool may also includes a presser bar. The off-lock member is preferably movable between a first position and a second position relative to the switch lever. The engaging part of the off-lock member is preferably in engagement with the housing when the off-lock member is at the first position so as to regulate the movement of the switch lever relative to the housing, and the engaging part of the off-lock member is preferably out of engagement with the housing when the off-lock member is at the second position so as to allow the movement of the switch lever relative to the housing. The switch lever may selectively turn ON and OFF the switch via the presser bar.

BRIEF DESCRIPTION OF THE DRAWINGS

The particular features and advantages of the invention as well as other objects will become apparent from the following description taken in connection with the accompanying drawings, in which.

DETAILED DESCRIPTION

Figure 1:
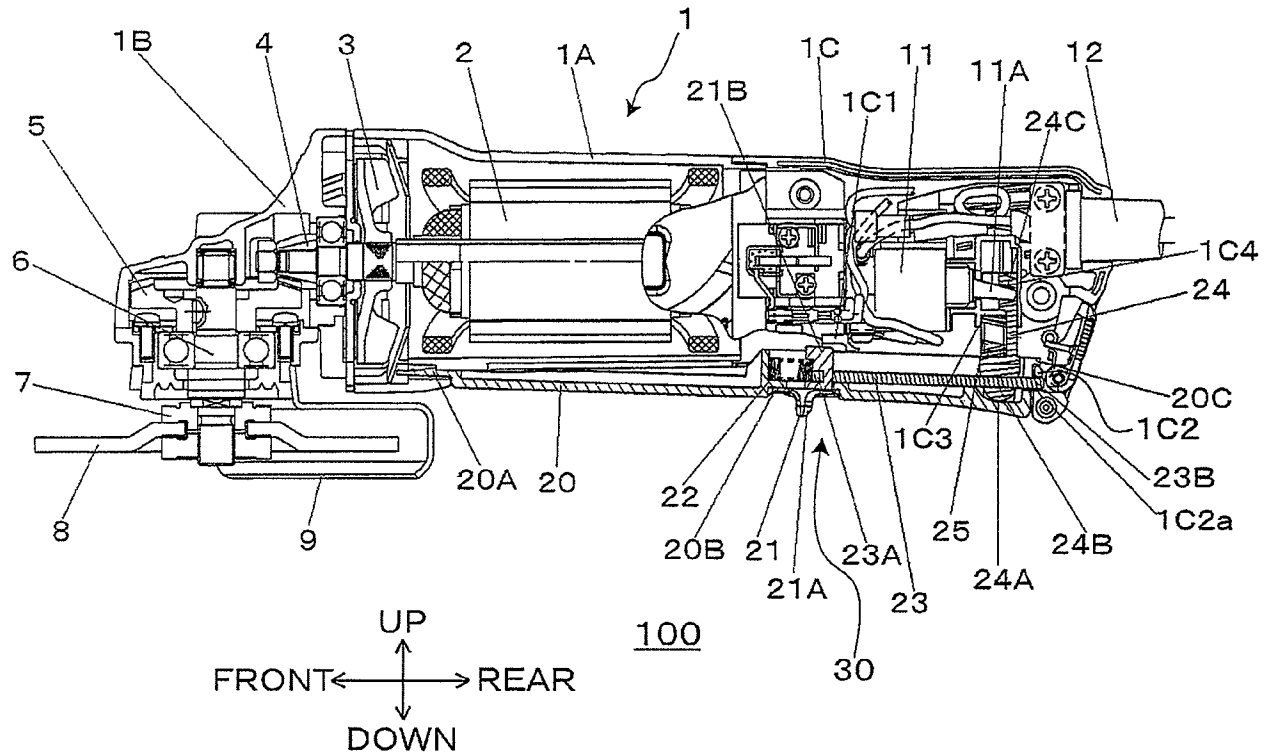
FIG. 1 is a partial cross-sectional side view of a power grinder according to an embodiment of the invention, with an off-lock member located at a rearward position.
Figure 2:
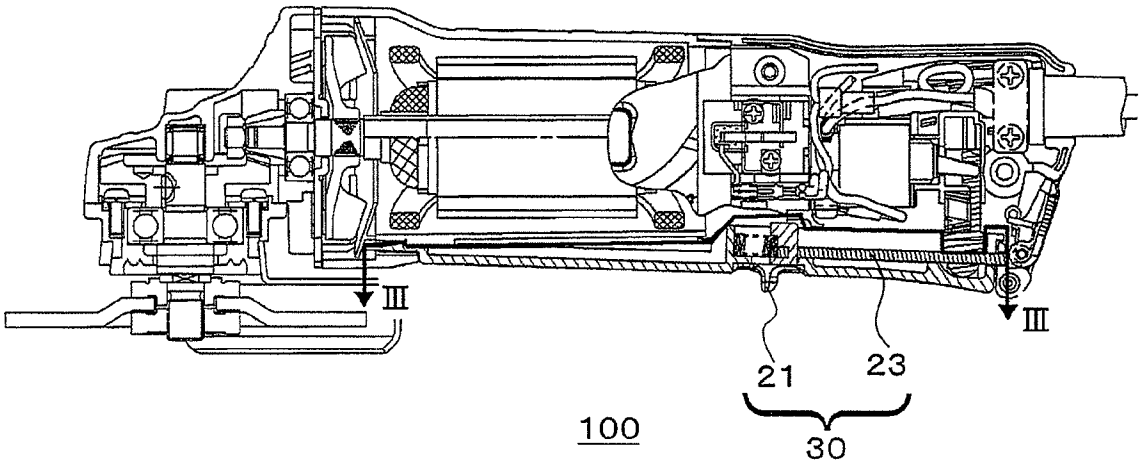
FIG. 2 is a partial cross-sectional side view identical to FIG. 1.

A power tool according to an embodiment of the invention will be described while referring to the accompanying drawings wherein like parts and components are designated by the same reference numerals to avoid duplicating description.

The terms "upward," "downward," "upper," "lower," "above," "right," "left," "front," "rear" and the like will be used throughout the description assuming that the power tool is disposed in an orientation in which it is intended to be used. In use, the power tool is disposed as shown in FIG. 1.

FIG. 1 shows a power grinder 100 as a power tool according to an embodiment of the invention. As shown in FIG. 1, the power grinder 100 includes a housing 1, an electric motor 2, a cooling fan 3, a pinion gear 4, a bevel gear 5, a spindle 6, a bit holder 7, and a wheel guard 9.

The housing 1 includes a motor housing 1A, a gear cover 1B, and a tail cover 1C. The motor housing 1A and the tail cover 1C are both made of resin, and the gear cover 1B is made of metal.

The motor housing 1A is formed in a cylindrical shape, and the gear cover 1B is fixed to a front section of the motor housing 1A by four screws not shown.

The tail cover 1C is fixed to a rear section of the motor housing 1A. The tail cover 1C includes a left part and a right part separable from each other and fixed to each other by a plurality of screws not shown. The tail cover 1C has an engaging part 1C1, an engaging member 1C2, a wall 1C3, and a guide 1C4 extending in an up-down direction. The engaging member 1C2 is formed with a hole 1C2*a*.

The motor 2 is accommodated in the motor housing 1A, and has a rotary shaft rotatably supported to the gear cover 1B. The fan 3 is fixed to the rotary shaft of the motor 2. The pinion gear 4 is also fixed to the rotary shaft of the motor 2 at a position frontward of the fan 3.

The gear cover 1B is formed with an exhaust opening (not shown) that spatially connects the fan 3 to the outside of the gear cover 1B.

The pinion gear 4 is in meshing engagement with the bevel gear 5, and the spindle 6 is fixed to the bevel gear 5. Rotation of the motor 2 is transmitted by the pinion gear 4 and the bevel gear 5 to the spindle 6 with its rotation direction changed by 90 degrees. The spindle 6 is rotatably supported by the gear cover 1B at two positions.

The bit holder 7 is fixed to a lower end of the spindle 6. The bit holder 7 supports a grindstone 8, which is a tool bit, such that the grindstone 8 cannot rotate relative to the bit holder 7.

The wheel guard 9 is fixed to the gear cover 1B and covers about a rear half of the grindstone 8.

The power grinder 100 also includes a switch 11 and a cord 12. The switch 11 is accommodated within and fixed to the tail cover 1C, and includes a protrusion 11A that protrudes from a rear section of the switch 11. Shifting the protrusion 11A to a lower position turns OFF the switch 11, and shifting the protrusion 11A to an upper position turns ON the switch 11.

The cord 12 extends from a rear section of the tail cover 1C, and is connected with a plug that can be plugged in a commercial outlet. The cord 12 is connected to the switch 11 to supply power from the outlet to the switch 11.

The power grinder 100 further includes a switch lever 20, an off-lock lever 21, a key 23, a presser bar 24, a first spring (urging member) 22, and a second spring 25. The presser bar 24 is formed with holes 24B and 24C. The off-lock lever 21 and the key 23 together function as an off-lock member 30.

Figure 3:
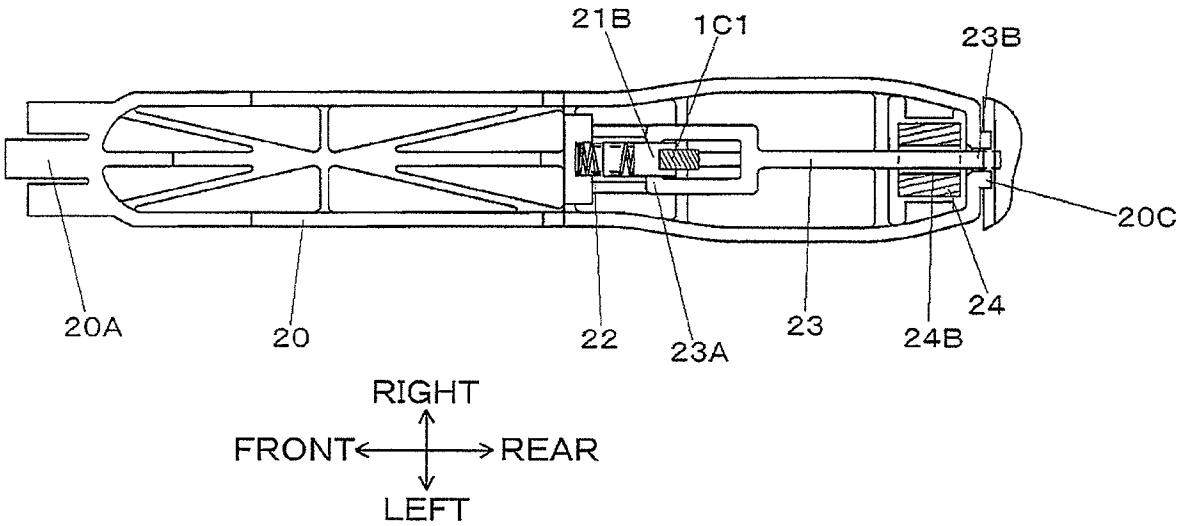
FIG. 3 is a cross-sectional view taken along a line III-III of FIG. 2.

The switch lever 20 extends along a front-rear direction. As shown in FIG. 3, the switch lever 20 is formed with a hinge part 20A at a front section thereof and a protrusion 20C at a rear section thereof. As shown in FIG. 1, the hinge part 20A is supported at a front lower part of the motor housing 1A, and the switch lever 20 is pivotable relative to the motor housing 1A about the hinge part 20A within a predetermined angle range. The protrusion 20C is located above and in alignment with the engaging member 1C2 of the tail cover 1C in the up-down direction, and is engageable with the engaging member 1C2 so as to prevent the switch lever 20 from being detached from the housing 1.

The off-lock lever 21 is mounted on the switch lever 20 at the midpoint thereof in the front-rear direction, so as to be movable in the front-rear direction relative to the switch lever 20 along a guide groove 20B formed at the midpoint of the switch lever 20. The off-lock lever 21 is provided with an operation part 21A (such as a knob) at a lower part thereof and an engaging part 21B at an upper part thereof.

More specifically, the operation part 21A is located at a front section of the tail cover 1C, and the engaging part 21B is located lower than the engaging part 1C1 in the up-down direction. When the off-lock lever 21 is at a rearward position as shown in FIG. 1, the engaging part 21B is in alignment with the engaging part 1C1 in the up-down direction and in engagement (contact) with a lower surface of the engaging part 1C1.

The key 23 is fixed to a rear section of the off-lock lever 21 and extends rearward to pass through the hole 24B formed in the presser bar 24. More specifically, the key 23 is provided with an engaging part 23A. As shown in FIG. 3, the engaging part 23A is connected to and fixed to right and left sides of the engaging part 21B of the off-lock lever 21.

Because the key 23 is fixed to the off-lock lever 21, when the off-lock lever 21 is moved frontward or rearward, the key 23 is also moved frontward or rearward. When the key 23 is moved rearward, a rear end 23B of the key 23 (the off-lock member 30) is received in the hole 1C2*a* formed in the engaging member 1C2 of the tail cover 1C. In other words, the rear end 23B of the off-lock member 30 engages with the hole 1C2. Note that the hole 24B of the presser bar 24 functions to guide the front-rear movement of the key 23.

The first spring 22 is disposed between the off-lock lever 21 and the switch lever 20 for urging the off-lock lever 21 rearward. In this embodiment, the first spring 22 is a coil spring, but an elastic rubber may be used instead of the first spring 22.

With this configuration, when an operator presses the off-lock lever 21 frontward against the urging force of the first spring 22, the off-lock lever 21 moves frontward together with the key 23 as the first spring 22 is compressed.

The second spring 25 is disposed between the wall 1C3 and the presser bar 24 for urging the presser bar 24 downward.

The presser bar 24 has a lower end 24A in contact with the switch lever 20. Also, the protrusion 11A of the switch 11 is inserted in the hole 24C of the presser bar 24. With this configuration, an upward movement of the switch lever 20 moves the presser bar 24 upward along the guide 1C4, which in turn moves the protrusion 11A upward, turning ON the switch 11.

When the off-lock lever 21 is at the rearward position shown in FIG. 1, the engaging part 21B is in engagement with the engaging part 1C1 in the up-down direction, and also the rear end 23B of the key 23 is within the hole 1C2*a* of the engaging member 1C2. Thus, both the off-lock member 30 (the off-lock lever 21 and the key 23) and the off-lock lever 21 cannot move upward.

Figure 4:
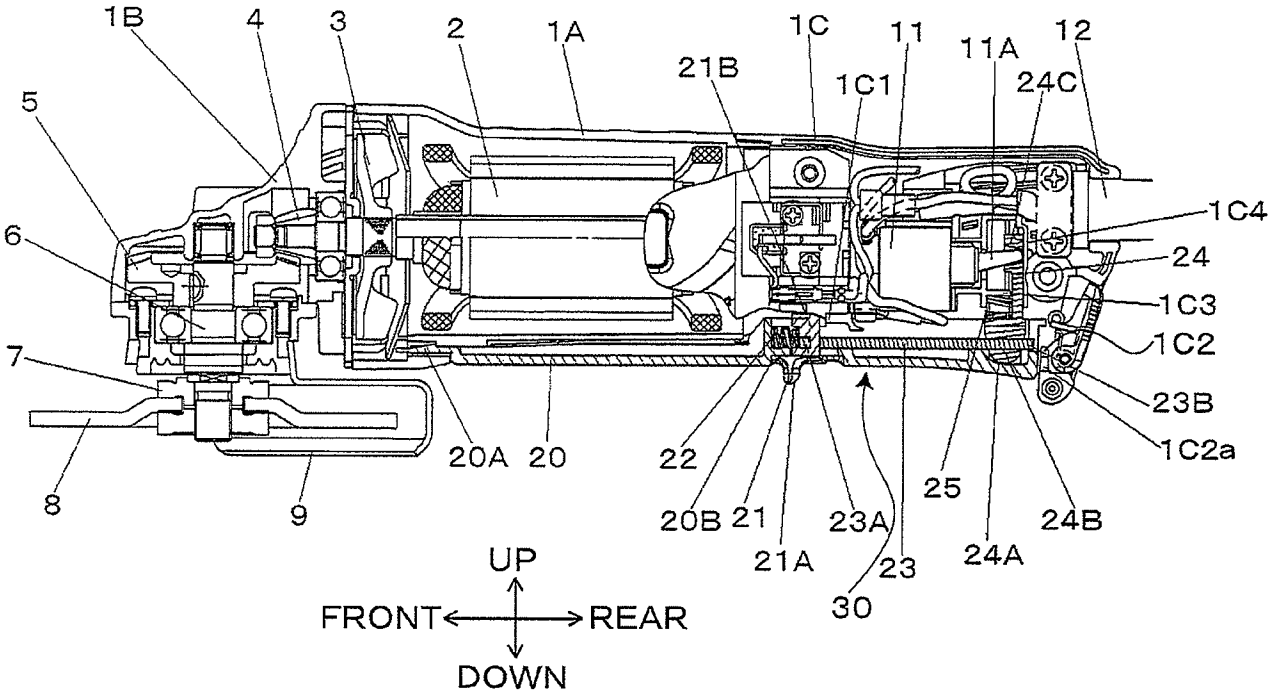
FIG. 4 is a partial cross-sectional side view of the power grinder with the off-lock member located at a frontward position.
Figure 5:
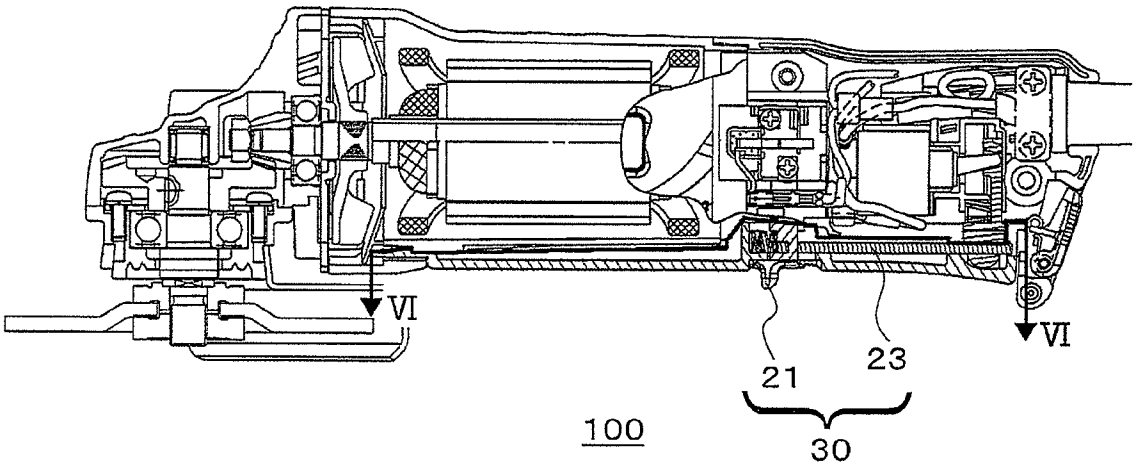
FIG. 5 is a partial cross-sectional side view identical to FIG. 4.
Figure 6:
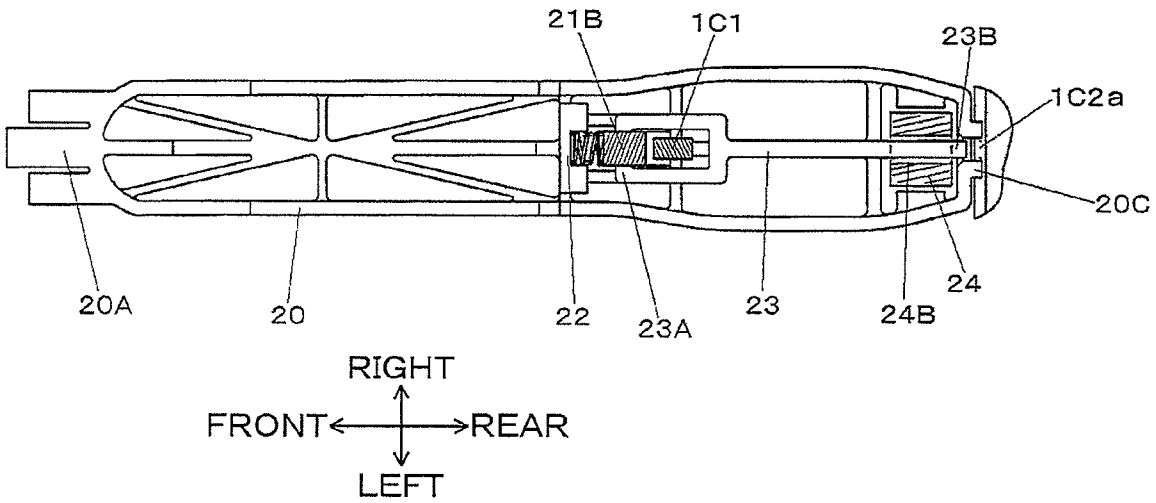
FIG. 6 is a cross-sectional view taken along a line VI-VI of FIG. 5.

In order to operate the power grinder 100, first an operator plugs the plug of the code 12 in a commercial outlet. Then, gripping the operation part 21A of the off-lock lever 21 with fingers, the operator presses the off-lock lever 21 frontward. As a result, the first spring 22 is compressed, and the off-lock lever 21 moves frontward to a frontward position shown in FIGS. 4 and 5, which in turn releases the engagement between the engaging part 21B and the engaging part 1C1 in the up-down direction as shown in FIG. 6. Because the key 23 fixed to the off-lock lever 21 also moves frontward, the rear end 23B of the key 23 is moved from a position within the hole 1C2*a* to a position outside the hole 1C2*a* as shown in FIG. 6. Thus, the upward movement of the 30 and thus the switch lever 20 is allowed.

Then, the operator presses the switch lever 20 upward against the urging force of the second spring 25. As a result, the switch lever 20 is moved upward together with the presser bar 24 as the second spring 25 is compressed. The upward movement of the presser bar 24 moves the protrusion 11A upward as described above, which in turn turns ON the switch 11 to start electric supply from the commercial outlet to the motor 2.

Upon receiving electric supply, the motor 2 starts to rotate, and rotation of the motor 2 rotates the fan 3 and the pinion gear 4.

Rotation of the pinion gear 4 rotates the bevel gear 5, the spindle 6 fixed to the bevel gear 5, the bit holder 7 fixed to the lower end of the spindle 6, and the grindstone 8 supported by the bit holder 7. The rotating grindstone 8 grinds a metal, concrete, or wooden workpiece (not shown). Because the rear half of the grindstone 8 is covered by the wheel guard 9, grind dusts and the like are prevented from scattering toward the rear (toward the switch lever 20).

When halting the operation, the operator stops pressing the switch lever 20 upward by, for example, simply releasing the fingers from the switch lever 20. Because the upward force is no longer applied to the switch lever 20, the urging force of the second spring 25 moves the presser bar 24 downward. Thus, the protrusion 11A received in the hole 24C also moves downward and turns OFF the switch 11, halting electric supply to the motor 2 and stopping rotation of the motor 2.

When the switch lever 20 returns to the lower position together with the off-lock lever 21 and the key 23, the rear end 23B of the key 23 comes into alignment with the hole 1C2*a* in the front-rear direction, and the urging force of the first spring 22 moves the off-lock lever 21 and the fan 3 rearward. As a result, the rear end 23B of the key 23 is received in the hole 1C2*a*, and the engaging part 21B engages with the engaging part 1C1. With this configuration, the upward movement of the switch lever 20 is again prevented.

As described above, according to this embodiment, the off-lock member 30 engages with the housing 1 at two positions (i.e., the engaging part 21B and the rear end 23B) when the off-lock member 30 is at the rearward position. Thus, the off-lock member 30 can reliably prevent the switch lever 20 from moving relative to the housing 1, and thus reliably prevents the switch lever 20 from accidentally turning ON the switch 11. This prevents waste of power.

Also, the rear end 23B of the off-lock member 30 that is located separate from the operation part 21A in the front-rear direction engages with the engaging member 1C2, and this configuration reliably prevents the switch lever 20 from moving to accidentally turn ON the switch 11. This prevents waste of power.

Further, because the off-lock lever 21 of the off-lock member 30 is located at the midpoint of the switch lever 20 in the front-rear direction, the operator can operate the off-lock lever 21 easily.

While the invention has been described in detail with reference to the embodiment thereof, it would be apparent to those skilled in the art that various changes and modifications may be made therein without departing from the spirit of the invention.

The power grinder 100 has been described above as an example of a power tool of the invention. However, the invention is not limited to a power grinder. For example, the invention is applicable to a power screw, a power driver, or a power impact driver. In this case, a driver bit or the like is used as a tool bit. The invention is also applicable to such a power saw as a power saber saw. In this case, a cutting blade or the like is used as a tool bit.

In the above-described embodiment, the code 12 is used for supplying power to the power grinder 100. However, the code 12 is not necessarily used. Power may be supplied from a rechargeable battery (lithium ion battery or nickel hydride battery).

What is claimed is:

1. A power tool comprising:

a motor having a rotary shaft extending in an axial direction;

a housing that accommodates the motor, the housing being provided with a first engaging member and a second engaging member, the second engaging member being provided separately from the first engaging member in the axial direction;

a switch that supplies power to the motor;

a switch lever that is provided movable relative to the housing to selectively turn ON and OFF the switch;

an off-lock member that is provided movable between a first position and a second position relative to the switch lever, the off-lock member including a first engaging part and a second engaging part, the first engaging part being engageable with the first engaging member, and the second engaging part being engageable with the second engaging member; and a presser bar provided between the switch lever and the switch, wherein the first engaging part and the second engaging part are in engagement with the first engaging member and the second engaging member, respectively, when the off-lock member is at the first position so as to regulate the movement of the switch lever relative to the housing, and the first engaging part and the second engaging part are out of engagement with the first engaging member and the second engaging member, respectively, when the off-lock member is at the second position so as to allow the movement of the switch lever relative to the housing, the switch comprises a protrusion extending in the axial direction, the protrusion being engageable with the presser bar, and the movement of the switch lever causes the presser bar to move the protrusion in a direction crossing the axial direction to turn ON and OFF the switch.

2. The power tool according to claim 1, wherein:

the housing extends in a predetermined direction from a first side toward a second side, and is provided with an engaging member on the second side;

the switch lever has a first end on the first side and a second end on the second side;

the off-lock member has an off-lock lever provided with the first engaging part, the off-lock lever being disposed at the midpoint of the switch lever with respect to the predetermined direction and separate from the second engaging part in the predetermined direction; and the second engaging part is engageable with the engaging member.

3. A power tool comprising:

a motor having a rotary shaft extending in an axial direction;

a housing that accommodates the motor, the housing having a first side and a second side opposite to the first side;

a gear disposed at the first side in the housing;

a bit holder that is connected to the gear;

a power supply member disposed at the second side of the housing;

a switch provided between the power supply member and the motor;

a switch lever that is provided movable relative to the housing to selectively turn ON and OFF the switch, the switch lever having a first end on the first side and a second end on the second side;

an off-lock member that is provided movable between a first position and a second position relative to the switch lever; and a presser bar provided between the switch lever and the switch, wherein:

the off-lock member has an off-lock lever disposed at the midpoint of the switch lever between the first end and the second end of the switch lever;

the housing is provided with a first engaging member located at the second side and a second engaging member separated from the first engaging member in the axial direction, the off-lock member has a third end on the second side that is engageable with the first engaging member and an engaging part that is engageable with the second engaging member, the third end of the off-lock member and the engaging part are in engagement with the first engaging member and the second engaging member, respectively, when the off-lock member is at the first position so as to regulate the movement of the switch lever relative to the housing, the third end of the off-lock member and the engaging pan are out of engagement with the first engaging member and the second engaging member, respectively, when the off-lock member is at the second position so as to allow the movement of the switch lever relative to the housing, the switch comprises a protrusion extending in the axial direction, the protrusion being engageable with the presser bar, and movement of the switch lever causes the presser bar to move the protrusion in a direction crossing the axial direction to turn ON and OFF the switch.

4. The power tool according to claim 3, further comprising an urging member that urges the off-lock member toward the second side.

5. A power tool comprising:

a motor having a rotary shaft extending in an axial direction;

a switch that supplies electric power to the motor;

a housing that accommodates the motor and extends in the axial direction from a first side toward a second side, the housing being provided with a first engaging member and a second engaging member separated from the first engaging member in the axial direction;

a switch lever that is disposed movable relative to the housing so as to selectively turn ON and OFF the switch;

an off-lock member that is disposed movable between a first position and a second position relative to the switch lever; and a presser bar provided between the switch lever and the switch, wherein the off-lock member includes an operation part, a rear end of a key disposed separate from the operation part in the axial direction, and an engaging part; and the rear end of the key and the engaging part are in engagement with the first engaging member and the second engaging member, respectively, when the off-lock member is at the first position so as to regulate the movement of the switch lever relative to the housing, the rear end of the key and the engaging part are out of engagement with the first engaging member and the second engaging member, respectively, when the off-lock member is at the second position so as to allow the movement of the switch lever relative to the housing, the switch includes a protrusion protruding from one end of the switch in the axial direction, the protrusion being engageable with the presser bar, and the movement of the switch lever causes the presser bar to move the protrusion in a direction crossing the axial direction to ON and OFF the switch.

6. The power tool according to claim 5, wherein:

the housing includes a motor housing that accommodates the motor and a tail cover that accommodates the switch;

the operation part of the off-lock member is located at a first section of the tail cover on the first side;

the key extends in the axial direction; and the engaging part is provided to the key, and is engageable with a second section of the tail cover on the second side.

7. The power tool according to claim 5, wherein the rear end of the key engaging part engages with the housing, thereby preventing the switch lever from moving.

8. A power tool comprising:

a motor having a rotary shaft extending in an axial direction;

a housing that accommodates the motor, the housing being provided with having a first engaging member and a second engaging member, the second engaging member being provided separately from the first engaging member in the axial direction;

a switch that supplies power to the motor;

a switch lever that is provided movable relative to the housing to selectively turn ON and OFF the switch; and an off-lock member that is provided movable between a first position and a second position relative to the switch lever, the off-lock member including a first engaging part and a second engaging part, the first engaging part being engageable with the first engaging member, and the second engaging part being engageable with the second engaging member, wherein the first engaging part and the second engaging part are in engagement with the first engaging member and the second engaging member, respectively, when the off-lock member is at the first position so as to regulate the movement of the switch lever relative to the housing, the first engaging part and the second engaging part are out of engagement with the first engaging member and the second engaging member, respectively, when the off-lock member is at the second position so as to allow the movement of the switch lever relative to the housing, the switch comprises a protrusion extending in the axial direction, and the movement of the switch lever causes the protrusion to move in a direction crossing the axial direction to turn ON and OFF the switch.

* * * * *